US008135296B2

(12) United States Patent
Nakane

(10) Patent No.: US 8,135,296 B2
(45) Date of Patent: Mar. 13, 2012

(54) IMAGE FORMING APPARATUS

(75) Inventor: Yoshimitsu Nakane, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 336 days.

(21) Appl. No.: 12/432,523

(22) Filed: Apr. 29, 2009

(65) Prior Publication Data

US 2009/0274476 A1 Nov. 5, 2009

(30) Foreign Application Priority Data

Apr. 30, 2008 (JP) ..... 2008-118805

(51) Int. Cl.
*G03G 15/20* (2006.01)

(52) U.S. Cl. ..... 399/68; 399/38; 399/49; 399/67

(58) Field of Classification Search ..... 399/38, 399/49, 67–70
See application file for complete search history.

(56) References Cited

U.S. PATENT DOCUMENTS 5,167,409 A * 12/1992 Higeta ..... 271/225
6,873,820 B2 * 3/2005 Tanaka et al. ..... 399/395
2005/0174377 A1 * 8/2005 Fujikura ..... 347/19
2005/0260003 A1 * 11/2005 Tezuka ..... 399/15
2005/0276631 A1 * 12/2005 Mori ..... 399/111
2008/0107438 A1 * 5/2008 Kinouchi et al. ..... 399/70
2008/0187341 A1 * 8/2008 Fujikura ..... 399/69

FOREIGN PATENT DOCUMENTS

JP 63-202776 8/1988
JP 4-16888 1/1992

* cited by examiner

*Primary Examiner* — David Porta
*Assistant Examiner* — Jessica L Eley
(74) *Attorney, Agent, or Firm* — Canon USA Inc. IP Division

(57) ABSTRACT

An image forming apparatus includes an image bearing member configured to bear a toner image on a surface thereof, a transfer unit configured to transfer the toner image on the image bearing member to a sheet, a fixing unit configured to heat and fix the toner image on the sheet transferred by the transfer unit, a reading unit configured to read the sheet that has passed through the fixing unit, from an end surface of the sheet, a control unit configured to control a fixing temperature when the fixing unit heats and fixes the toner image on the sheet, based on an image read by the reading unit.

8 Claims, 14 Drawing Sheets

IMAGE FORMING APPARATUS

BACKGROUND OF THE INVENTION

1. Field of the Invention

The present invention relates to an image forming apparatus for forming a toner image on a sheet, and more particularly to an image forming apparatus including a fixing device for heating and fixing the toner image transferred onto the sheet.

2. Description of the Related Art

The conventional image forming apparatuses such as a copy machine and a laser printer include a transfer device for transferring a toner image formed on an image bearing member onto a sheet and a fixing device for heating the sheet onto which the toner image is transferred and fixing the toner image on the sheet.

For example as described in Japanese Patent Application Laid-Open Nos. 63-202776 and 4-16888, in order to stably fix the toner image onto the sheet, the conventional fixing device detects a temperature on a surface of a fixing roller that gives heat to the sheet and controls a heat amount of a heater serving as a heating device.

Various types of environments and paper are tested when the fixing device is developed, and a mutual relation between a preparation temperature on a surface of a fixing roller and a melting state of the toner on the sheet is taken into consideration to determine a preparation temperature of the heater.

However, even when a temperature on a surface of the fixing roller is controlled to be constant, the toner is differently fixed on the sheet due to a change of a surface hardness of the fixing roller or a moisture absorption state of the toner. Accordingly, the toner cannot be stably fixed on the sheet only by detecting the temperature on the surface of the fixing roller and controlling the heat amount of the heater.

SUMMARY OF THE INVENTION

The present invention is directed to an image forming apparatus for stably fixing toner on a sheet and preventing an image from being deteriorated due to poorly fixed toner.

According to an aspect of the present invention, an image forming apparatus includes an image bearing member configured to bear a toner image on a surface thereof, a transfer unit configured to transfer the toner image on the image bearing member to a sheet, a fixing unit configured to heat and fix the toner image on the sheet transferred by the transfer unit, a reading unit configured to read the sheet that has passed through the fixing unit, from an end surface of the sheet, a control unit configured to control a fixing temperature when the fixing unit heats and fixes the toner image on the sheet, based on an image read by the reading unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

An image forming apparatus according to a first exemplary embodiment of the present invention will be described. According to the present exemplary embodiment, a color image forming apparatus of an electrophotographic type will be described as an example of an image forming apparatus 1.

Figure 1:
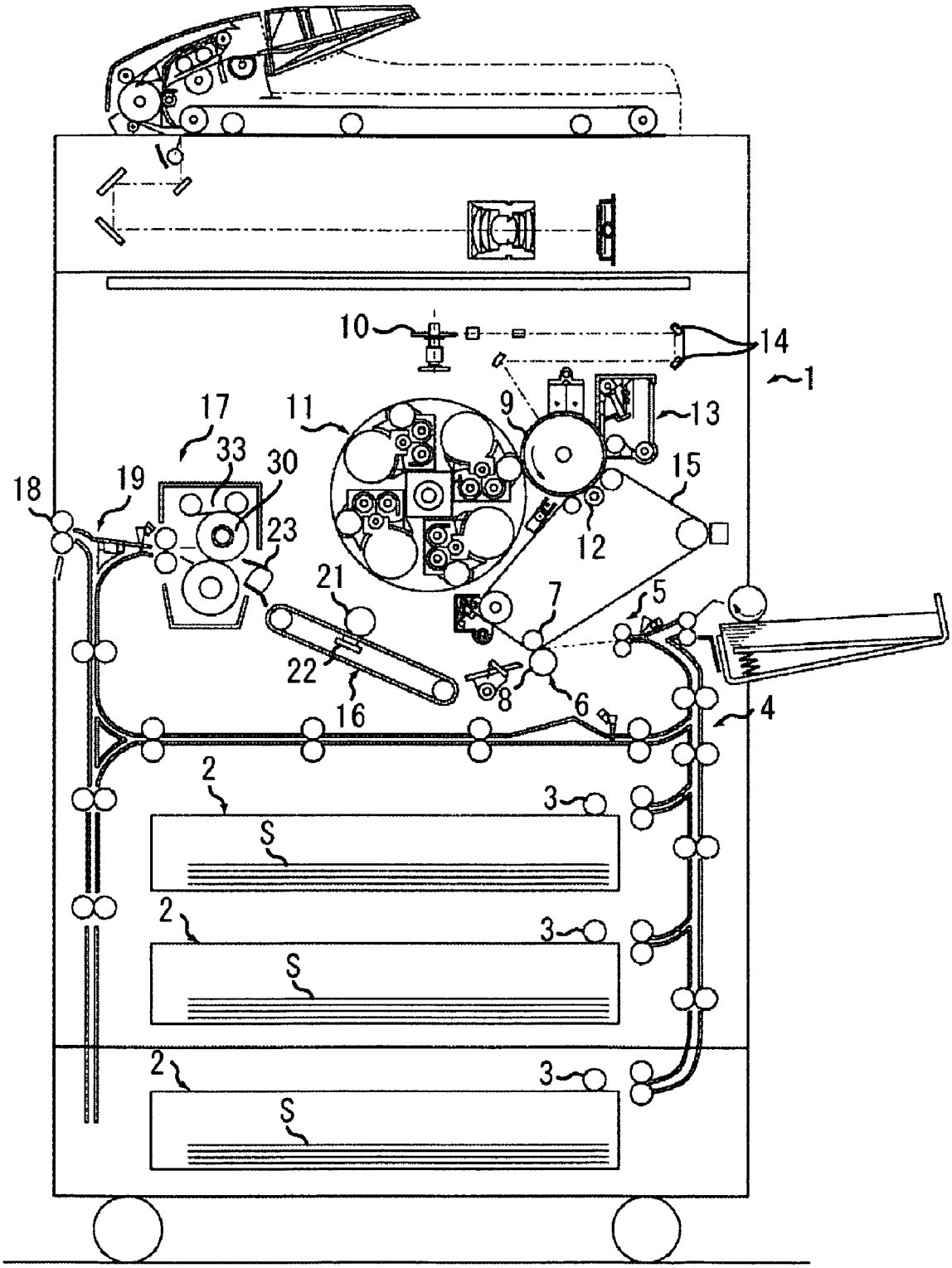
FIG. 1 is a cross sectional view of an image forming apparatus according to a first exemplary embodiment.

FIG. 1 is a cross sectional view of the image forming apparatus 1.

A sheet S is fed by a feeding roller 3 in a sheet storing unit 2. The sheet S fed out by the feeding roller 3 passes through a conveyance path 4 and is fed to a registration roller 5. The registration roller 5 that is standing still stops the sheet S so that skew of the sheet S is corrected. Then, the registration roller 5 rotates to feed the sheet S to a second transfer unit 6.

The second transfer unit 6 is a nip unit formed of a second-transfer inside roller 7 and a second-transfer outside roller 8 that oppose each other, and a predetermined pressure force and an electrostatic load bias are applied to the second transfer unit 6 so that a toner image adheres to the sheet S.

The image forming unit includes a photosensitive member 9, an exposure device 10, a development device 11, a first transfer device 12, and a photosensitive cleaner 13.

The photosensitive member 9 as an image bearing member rotates in a direction of an arrow as illustrated in FIG. 1, and a surface of the photosensitive member 9 is evenly charged by a charging device in advance. Then, the charged surface is exposed by an exposure device 10 via a mirror 14 according to image information.

More specifically, the exposure device 10 exposes the evenly charged surface of the photosensitive member 9 with a laser beam that is ON/OFF controlled (modulation controlled) according to a time-series electric digital image signal of the image information. By this exposure, a potential of the exposed portion on the evenly charged surface of the photosensitive member 9 is attenuated, and an electrostatic latent image is formed on a surface of the photosensitive drum according to the image information.

The electrostatic latent image formed on the photosensitive member 9 is developed with the toner by the development device 11 and becomes visible as the toner image on the photosensitive member 9. Thereafter, the predetermined pressure force and the electrostatic load bias are applied by the first transfer device 12, and the toner image is transferred onto an intermediate transfer belt 15. Then, the toner that slightly remains after the transfer on the photosensitive member 9 is collected by a photosensitive cleaner 13 and prepared for the next image forming.

The development device 11 includes therein development units of yellow (Y), magenta (M), cyan (C), and black (Bk), which are changed according to a latent image color formed on the photosensitive member 9 to form the toner image on the photosensitive member 9. After the toner image is formed, the image having Y, M, C, and Bk is transferred on the intermediate transfer belt 15, and color toner images are superimposed. The color toner image transferred onto the intermediate transfer belt 15 is fed to the second transfer unit 6.

After the process of feeding the sheet S and the toner image forming process are performed as described above, a full-color toner image is secondly transferred onto the sheet S in the second transfer unit 6. After that, the sheet S is fed to a fixing device 17 by a conveying belt 16.

The fixing device 17 causes the opposing roller to apply the predetermined pressure force to the sheet S, and causes a fixing heater 30 in a fixing roller 33 to apply the heat to the sheet S so that the toner image transferred onto the sheet S can be melted and firmly fixed. The sheet S that has passed through the fixing device 17 is discharged out of the image forming apparatus 1 by a discharge roller 18.

At a downstream side of the fixing device 17 in a direction of feeding the sheet, a sheet-end-surface reading device 19 for detecting fixability of the toner on the sheet S is provided. When the fixability of the toner is detected by using the sheet-end-surface reading device 19, a test sheet on which a toner image having predetermined patterns is formed is used.

Figure 2:
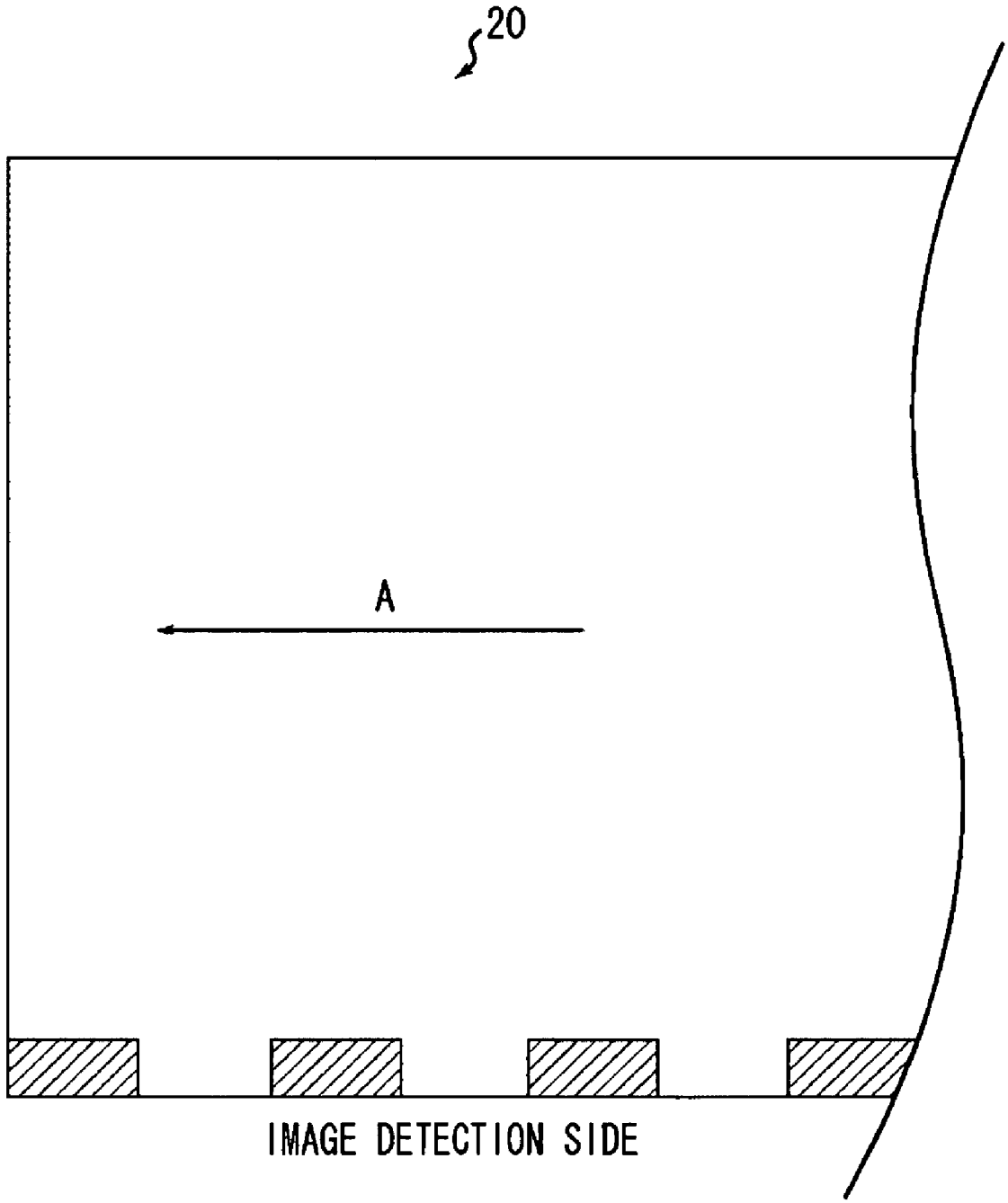
FIG. 2 is a diagram illustrating image patterns on a test sheet according to the first exemplary embodiment.

FIG. 2 is a diagram illustrating image patterns on a test sheet 20.

As illustrated in FIG. 2, the image patterns having a predetermined width and predetermined spaces therebetween are formed on an end portion of the test sheet 20. The sheet-end-surface reading device 19 reads the image on the end portion of the test sheet 20 to detect the fixability of the toner on the test sheet 20. The details about the fixability will be described below.

When the fixability of the toner is detected by using the test sheet 20, the sheet S is skew fed by a skew-feed roller 21 illustrated in FIG. 1. The skew-fed sheet S is stopped by a stop board 23 so that a position of the sheet S in a width direction orthogonal to a direction of feeding the sheet S is corrected. By correcting the position in the width direction of the sheet S, the sheet-end-surface reading device 19 can appropriately read the image on the end surface of the sheet.

Since the image patterns are formed only on the end portion of the test sheet 20, there will be no problem if the skew-feed roller 21 contacts the sheet S before the fixing. However, when an image is formed in an usual process, if the skew-feed roller 21 contacts a toner image before the fixing, the image will be disturbed. Thus, the skew-feed roller 21 is separated away from the sheet S.

FIGS. 3 to 6 are top plan views each illustrating the fixing device 17 and the circumstance thereof.

Figure 3:
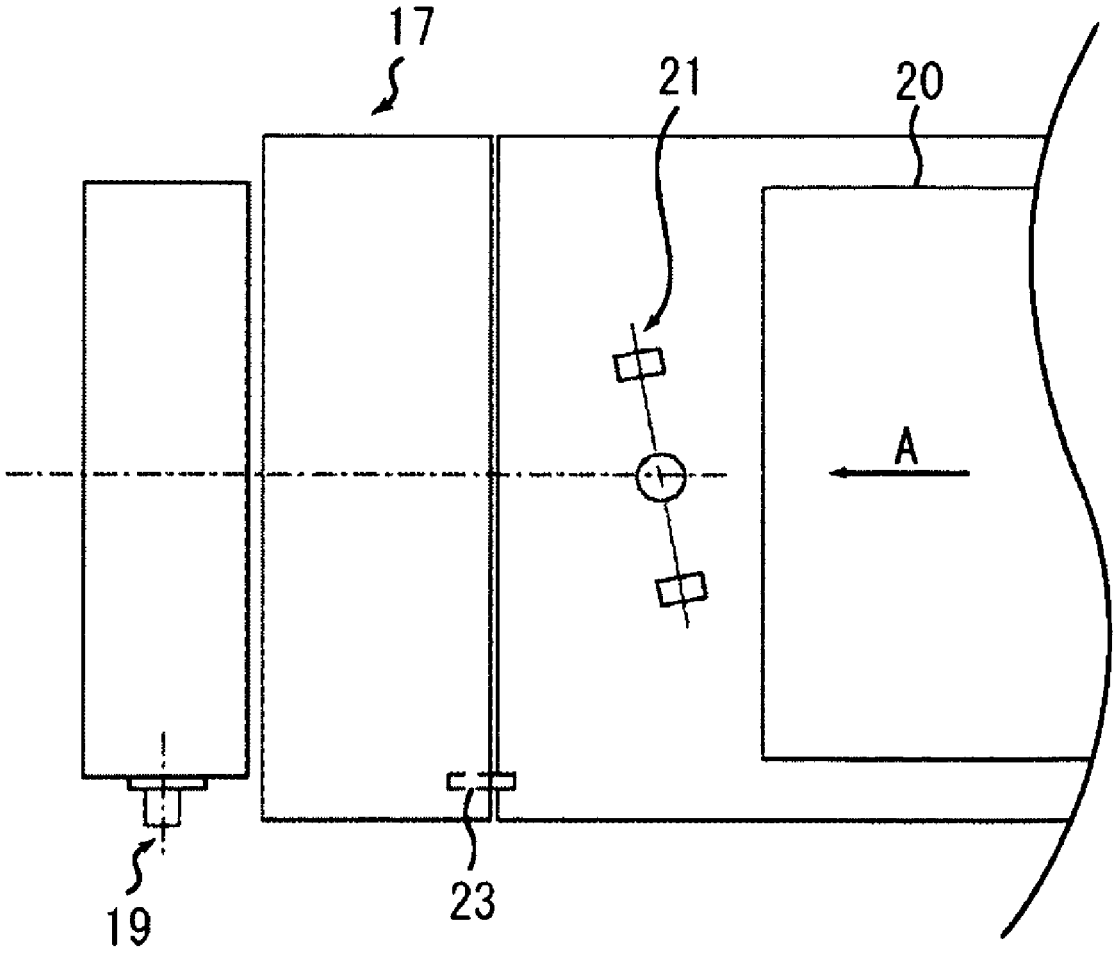
FIG. 3 is a top plan view illustrating a fixing device and a circumference thereof according to the first exemplary embodiment.
Figure 4:
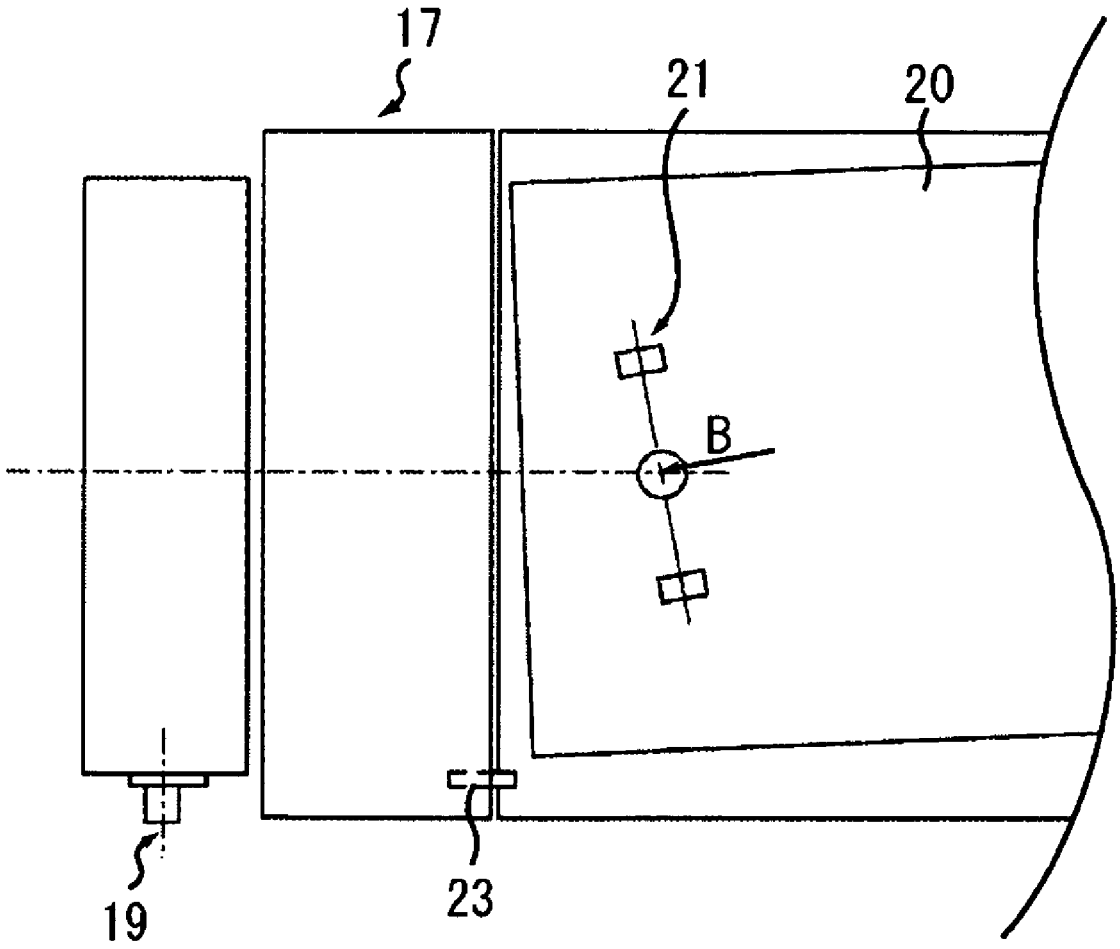
FIG. 4 is a top plan view illustrating the fixing device and the circumference thereof according to the first exemplary embodiment.

In FIG. 3, the test sheet 20 is fed in a direction of an arrow A as illustrated the figure. The feeding direction of the test sheet 20 fed by the conveying belt 16 is changed by the skew-feed roller 21 that is skewed at a predetermined angle with respect to the feeding direction A. The test sheet 20 is, fed in a direction of an arrow B as illustrated in FIG. 4.

Further, as illustrated in FIG. 1, a sheet-thickness detecting sensor 22 is provided to detect a width of the test sheet 20 fed by the skew-feed roller 21. The sheet-thickness detecting sensor 22 is a distance measuring sensor of an optical distance measuring type including a light emitting diode and a photo diode. The optical distance measuring type is a conventional formula by which a distance is calculated based on a position where the reflected light that is emitted from the light emitting diode and reflected on a detection target enters the photo diode.

More specifically, when the test sheet 20 is inserted between the skew-feed roller 21 and the conveying belt 16, the conveying belt 16 approaches the sheet-thickness detecting sensor 22 according to the thickness of the test sheet 20. The sheet-thickness detecting sensor 22 measures a distance to the conveying belt 16 to detect the thickness of the test sheet 20 before the fixing.

Figure 5:
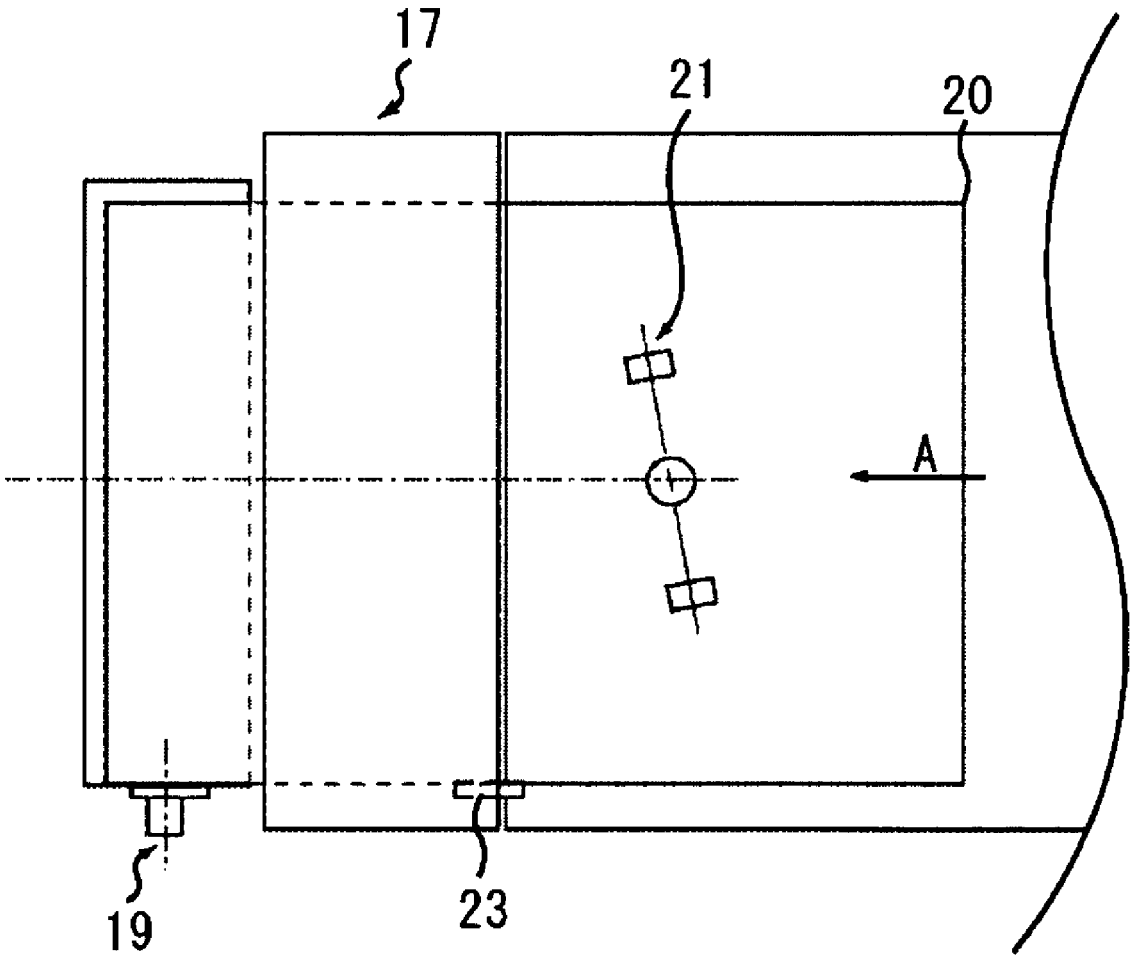
FIG. 5 is a top plan view illustrating the fixing device and the circumference thereof according to the first exemplary embodiment.

As illustrated in FIG. 5, the test sheet 20 skew fed by the skew-feed roller 21 is stopped by the stop board 23 provided at an end portion of the fixing device 17 just before entering the fixing device 17 and the skew is corrected. Then, the test sheet 20 is fed in the direction of the arrow A again. At this point, the skew-feed roller 21 is separated from the test sheet 20 by a skew-feed roller separating unit 36 as described below.

Thereafter, the test sheet 20 passes through the fixing device 17, and the toner image is heated and fixed. The sheet-end-surface reading device 19 provided at the downstream side of the fixing device 17 in a direction of feeding the sheet reads the image patterns formed on the test sheet 20 from the side surface of the sheet.

Figure 6:
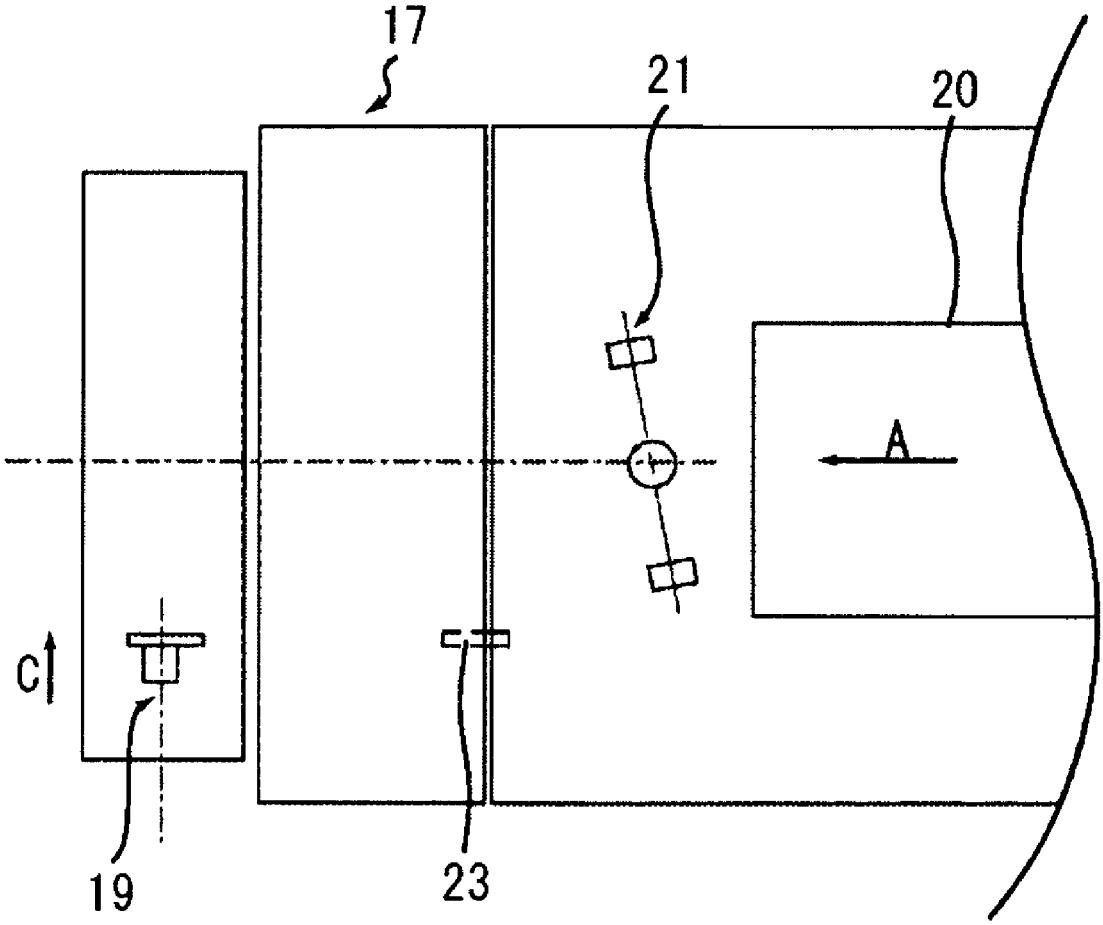
FIG. 6 is a top plan view illustrating the fixing device and the circumference thereof according to the first exemplary embodiment.

When a size of the test sheet 20 is small (for example, B5 longitudinal feed or A4 longitudinal feed), the stop board 23 and the sheet-end-surface reading device 19 move in a direction of an arrow C as described in FIG. 6. With this arrangement, a position of the test sheet 20 in the width direction orthogonal to the sheet feeding direction can be determined according to the size of the test sheet 20. Therefore, the end surface of the test sheet 20 can be read by causing the test sheet 20 to contact the sheet-end-surface reading device 19.

Figure 7:
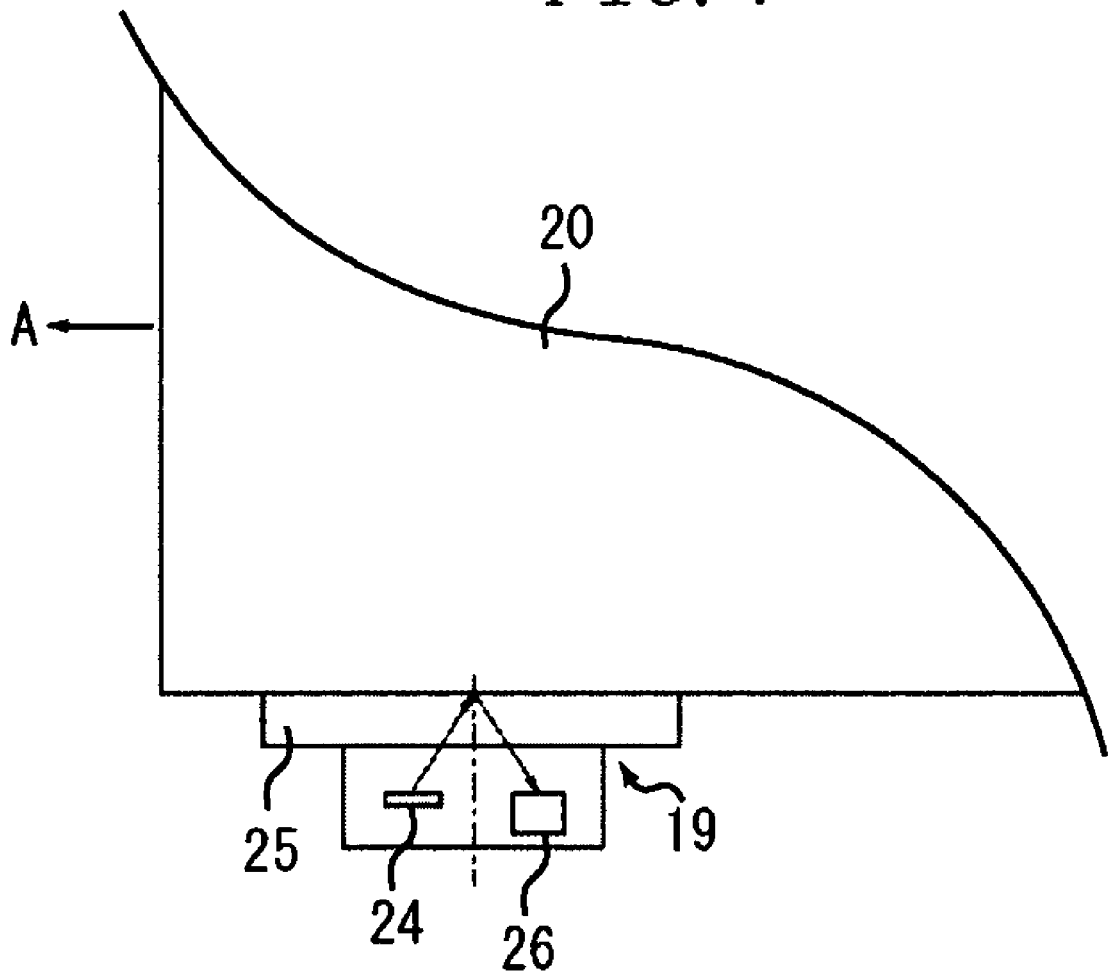
FIG. 7 is a diagram illustrating a configuration of a sheet-end-surface reading device according to the first exemplary embodiment.

FIG. 7 is a diagram illustrating a configuration of the sheet-end-surface reading device 19.

The sheet-end-surface reading device 19 includes a light emitting diode (LED) 24, a transparent stop board 25 through which light emitted from the LED 24 passes, a complementary metal-oxide semiconductor (CMOS) 26 that receives light reflected from the end surface of the test sheet 20.

Figure 8:
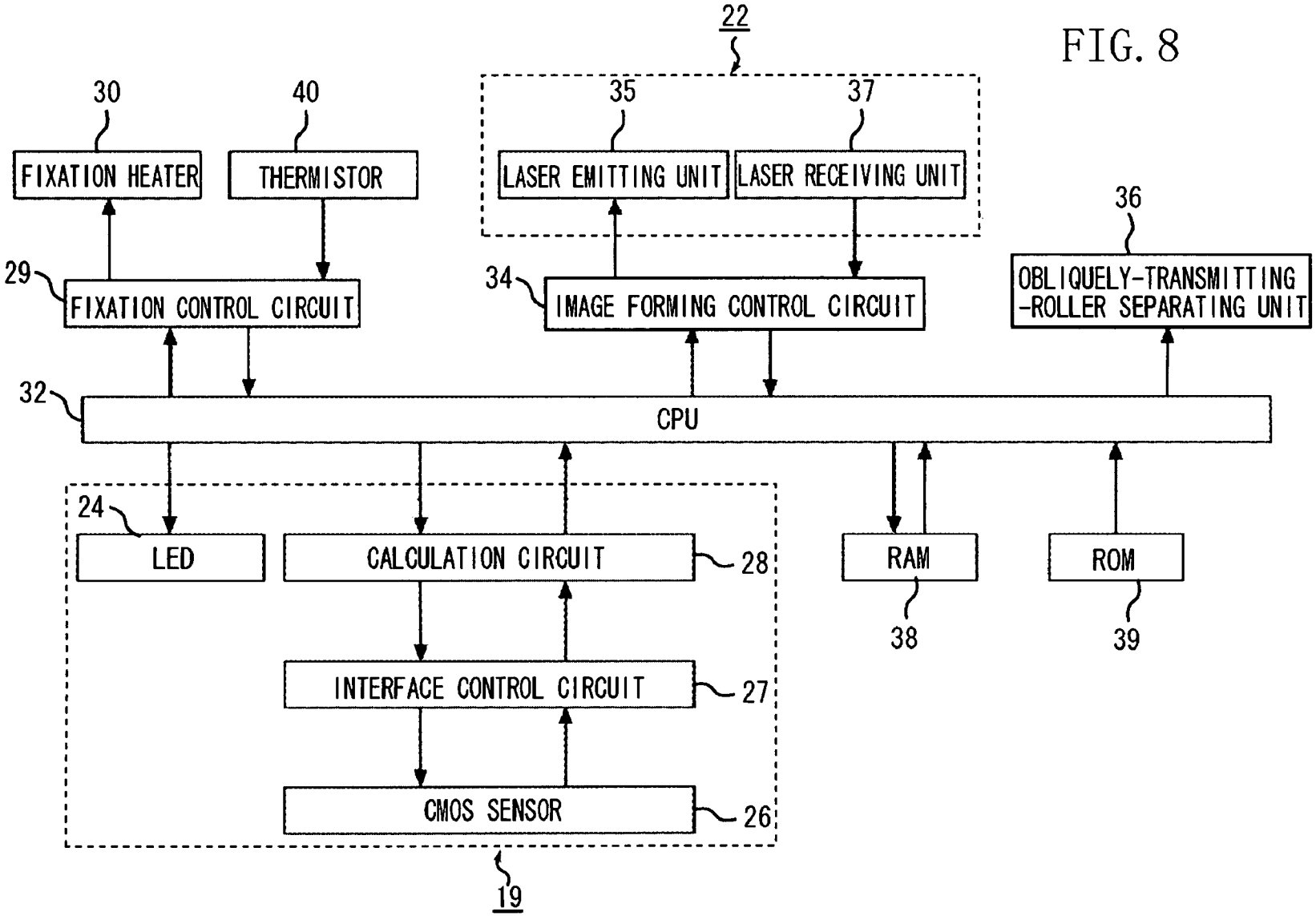
FIG. 8 is a control block diagram illustrating the image forming apparatus according to the first exemplary embodiment.

FIG. 8 is a control block diagram of the image forming apparatus 1.

A central processing unit (CPU) 32 is an integrated circuit that gives instructions to a fixing/fixation control circuit 29 and an image-forming control circuit 34 to control the whole apparatus. The CPU 32 is connected to a random access memory (RAM) 38 providing a working area and a read only memory (ROM) 39 storing a control program.

A thermistor 40 is a sensor that detects a temperature on a surface of the fixing roller 33 heated by the fixing heater 30 in the fixing device 17 and is disposed on a surface of the fixing roller 33. The fixing control circuit 29 controls the fixing heater 30 according to the detection results obtained by the thermistor 40.

A light emitting unit 35 and a laser receiving unit 37 are provided within the sheet-thickness detecting sensor 22. The image-forming control circuit 34 controls light emission of the laser emitting unit 35 and irradiates the sheet S with a laser beam. The light reflected from the sheet S is received by the laser receiving unit 37.

The skew-feed roller separating unit 36 is provided to separate the skew-feed roller 21 from the conveying belt 16 and is formed of solenoid, etc.

The CPU 32 controls light emission of the LED 24 provided in the sheet-end-surface reading device 19. Light emitted from the LED 24 falls on the end surface of the sheet and reflected therefrom. The CMOS sensor 26 receives the reflected light from the end surface of the sheet and acquires the image information of the end surface.

The interface control circuit 27 stores the image information from the CMOS sensor 26. A calculation circuit 28 calculates a feature amount of the image information stored in the interface control circuit 27. The calculation of the feature amount will be described in detail below.

Figure 10:
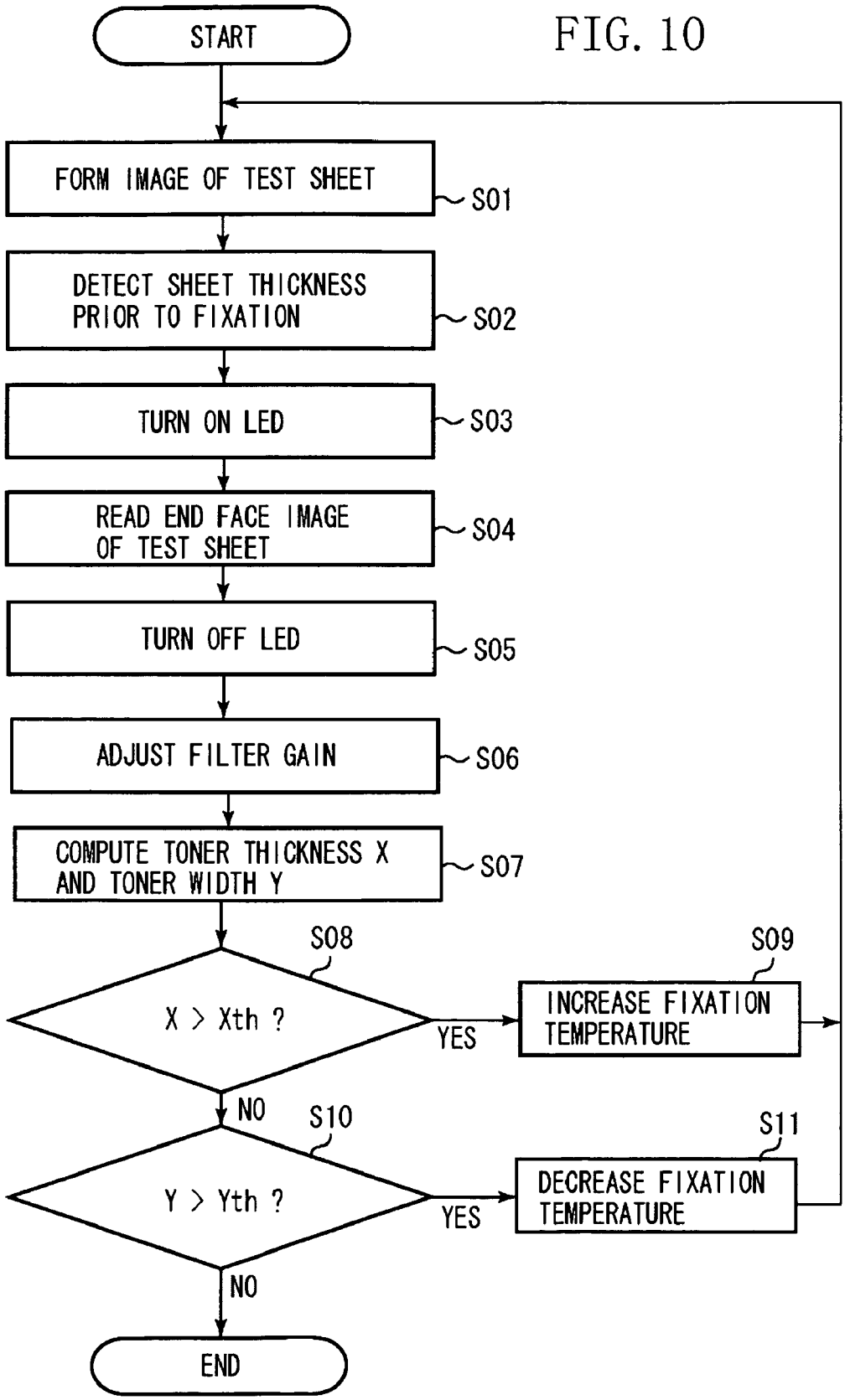
FIG. 10 is a flowchart illustrating a control process when a sheet end surface is read according to the first exemplary embodiment.

FIG. 10 is a flowchart illustrating a control process when a sheet end surface is read.

The ROM 39 stores the control program for executing the flowchart and the CPU 32 executes the control program. The CPU 32 automatically executes the control based on the flowchart when the power of the image forming apparatus 1 is turned on or the image is adjusted.

Firstly, in step S01, the CPU 32 gives an instruction to the image-forming control circuit 34 to form the images on the test sheet 20. On the end surface of the test sheet 20, the images are formed having a predetermined width and spaces therebetween as illustrated in FIG. 2. Next, in step 02, the CPU 32 detects the thickness of the test sheet 20 before the fixing in accordance with the detection result of the sheet-thickness detecting sensor 22.

Next, in step S03, the CPU 32 causes the LED 24 provided in the sheet-end-surface reading device 19 to light up. In step S04, the CPU 32 causes the CMOS sensor 26 to read the image information of the end surface of the test sheet 20. When the image information has been read, in step S05, the CPU 32 causes the LED 24 to go out. Next, in step S06, the CPU 32 adjusts a filter gain to make clearer the image on the end surface of the test sheet 20.

Figure 9:
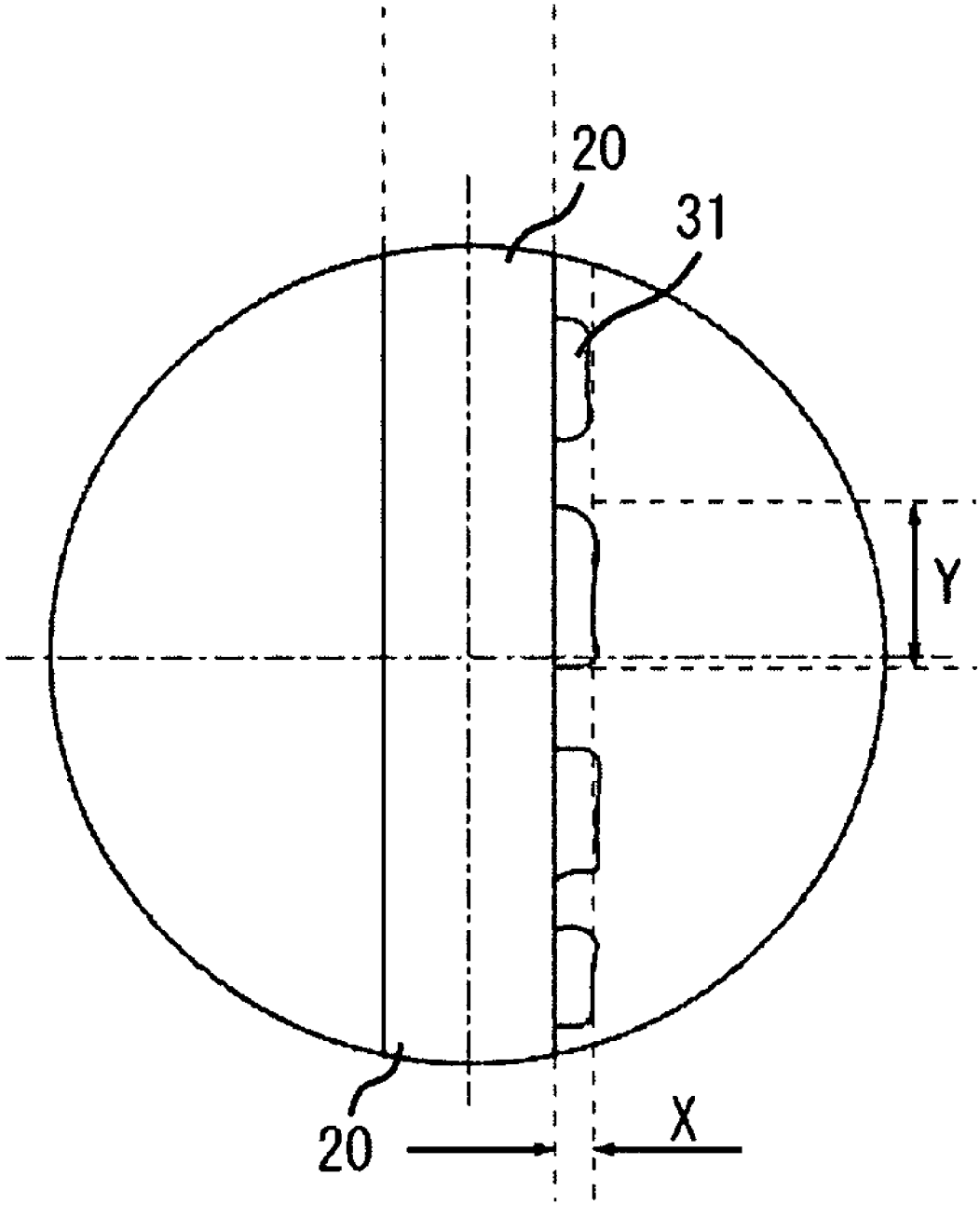
FIG. 9 illustrates one example of image information on an end portion of a test sheet according to the first exemplary embodiment.

One example of the image information of the end surface of the test sheet 20 acquired by executing the above-described process is illustrated in FIG. 9.

In step S07, the CPU 32 stores the acquired image information in the interface control circuit 27 and causes the calculation circuit 28 to calculate the thickness "X" and the width "Y" of the toner 31 as the feature amount of the image. The thickness "X" of the toner 31 means a length in a height direction of the toner image and the width "Y" of the toner 31 means a length in a direction orthogonal to the height direction of the toner image.

In step S08, the CPU 32 determines whether the thickness of the toner is larger than the threshold value Xth that is previously set. When it is determined that the thickness of the toner "X" is larger than the threshold value Xth in step S08, in step S09, the CPU 32 gives an instruction to the fixing control circuit 29 to increase a fixing temperature.

More specifically, when the thickness "X" of the toner is larger than the threshold value Xth, it is considered that the toner has insufficiently melted, which causes poor fixability. Thus, the heater 30 is controlled to increase the fixing temperature.

When it is determined that the thickness "X" is equal to the threshold value Xth or less in step S08, in step S10, the CPU 32 determines whether the width "Y" of the toner that is previously set is larger than the threshold value Yth. When it is determined that the width "Y" of the toner is larger than the threshold value Yth in step S10, in step S11, the CPU 32 gives an instruction to the fixing control circuit 29 to decrease the fixing temperature.

More specifically, when the width "Y" of the toner is larger than the predetermined value, it is considered that the good image can not be obtained because the toner melts too much and spreads out, which causes the crushed toner. Thus, the CPU 32 controls the fixing heater 30 to decrease the fixing temperature.

Upon changing the fixing temperature in steps S09 and S11, the CPU 32 returns to step S01 to perform the above-described processing again. On the other hand, when it is determined that the width "Y" of the toner is equal to the threshold value Yth or less in step S10, the CPU 32 ends this flow.

Figure 11:
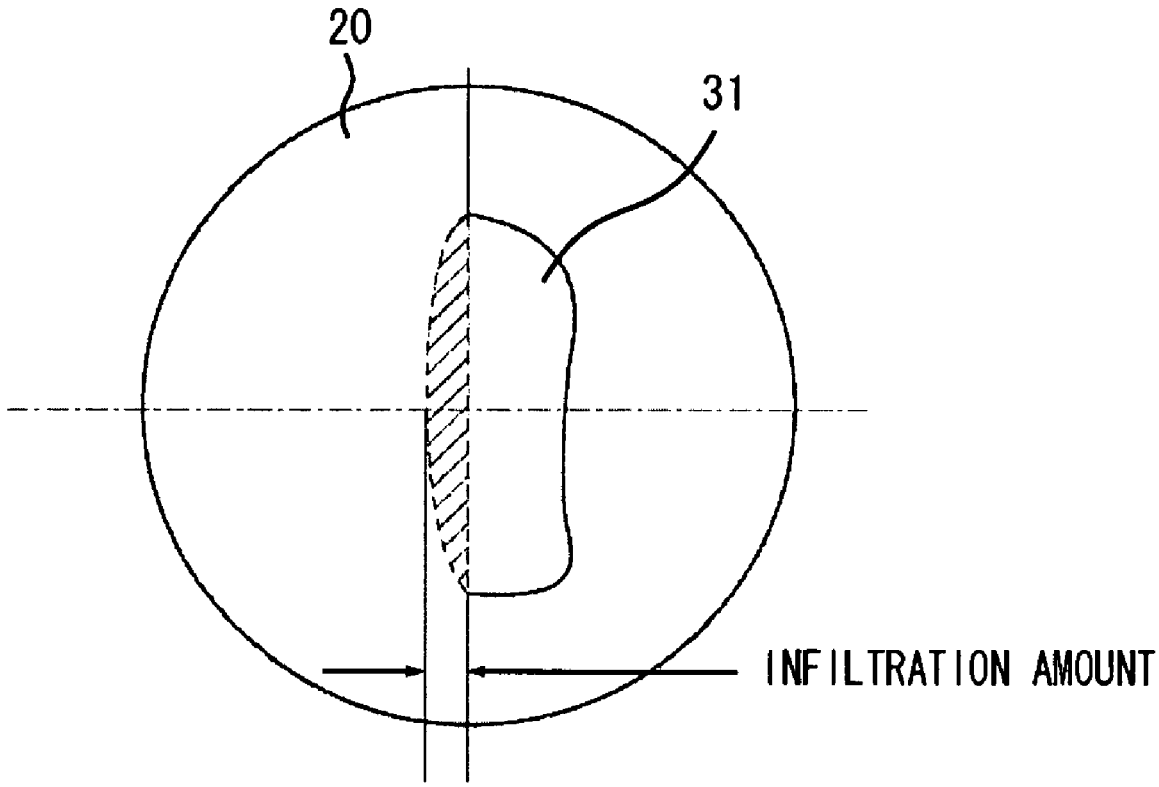
FIG. 11 illustrates another example of the image information on the end portion of the test sheet according to the first exemplary embodiment.

The above description shows the thickness "X" and the width "Y" of the toner as an example of the feature amount, however, the feature amount is not limited to the embodiment as described above. For example, as illustrated in FIG. 11, an infiltration amount of the melted toner image infiltrating into the test sheet 20 may be calculated as the feature amount. The toner melted by the heat infiltrates into the sheet. Since the infiltrated portion is colored, the colored portion viewed from the side surface of the sheet is determined as the infiltration amount.

In this case, when the infiltration amount of the melted toner image into the test sheet 20 is small, it is considered that the toner on the sheet has insufficiently melted, which causes the poor fixability. The CPU 32 may control the fixing heater 30 so that the fixing control circuit 29 increases the fixing temperature.

Further, a shrinkage rate of the sheet may be also used as the feature amount. After passing through the fixing device 17, the moisture in the sheet evaporates and the sheet shrinks. If the sheet shrinks too much, quality of the output product is deteriorated. Thus, when the sheet shrinks by more than a predetermined value, the CPU 32 controls the fixing heater 30 to decrease the fixing temperature to decrease an amount of shrinkage.

The shrinkage rate can be calculated based on thickness information of the test sheet 20 before the fixing detected by the sheet-thickness detecting sensor 22 and thickness information after the fixing detected from the image information of the end surface of the test sheet 20.

As described above, according to the image forming apparatus of the first exemplary embodiment, the fixability of the toner is kept constant to prevent the image from being deteriorated due to the poor fixing.

Along with popularization of digital cameras in recent years, it is desired that the image forming apparatus such as a copy machine and a printer using an electrophotographic type for outputting an image can output the image which is as highly glossy as silver halide photography. Therefore, a second fixing device is discussed which is connected to the image forming apparatus and gives gloss as much as the silver halide photography on the sheet output from the image forming apparatus.

Figure 12:
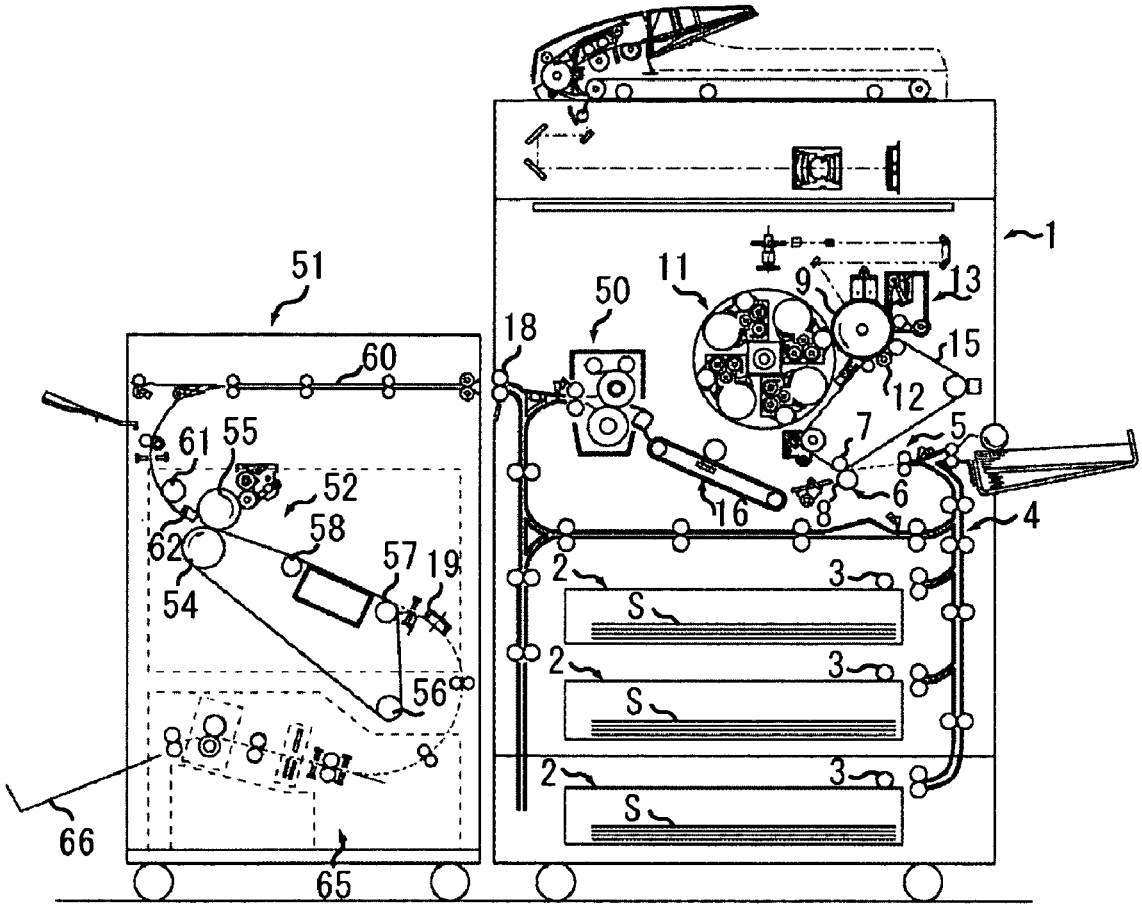
FIG. 12 is a cross sectional view of the image formation apparatus and a second fixing device according to a second exemplary embodiment.

FIG. 12 is a cross sectional view of the image formation apparatus and a second fixing device according to the second exemplary embodiment. Similar symbols are given to the components having functions similar to the first exemplary embodiment, and the descriptions are not repeated.

The sheet S fixed by a first fixing device 50 that is disposed inside the image forming apparatus 1 is discharged out of the image forming apparatus 1 by the discharging roller 18 and fed into a second fixing device 51.

The sheet S fed to the second fixing device 51 passes through a conveyance pass 60. Then, the end surface of the sheet S, which is guided by a skew-feed roller 61, contacts a stop board 62 before entering an inside of the heating and cooling device 52, and skew is corrected similar to the first exemplary embodiment. When the sheet S enters the heating and cooling device 52, the skew-feed roller 61 is separated at the same time.

Next, the heating and cooling device 52 fixes and cools the sheet S. After the sheet S passes through the heating and cooling device 52, the sheet-end-surface reading device 19 having the configuration similar to the first exemplary embodiment reads the image on the end surface of the sheet S. After a post processing device 65 performs post processing on, the sheet S is discharged to a discharge tray 66.

Figure 13:
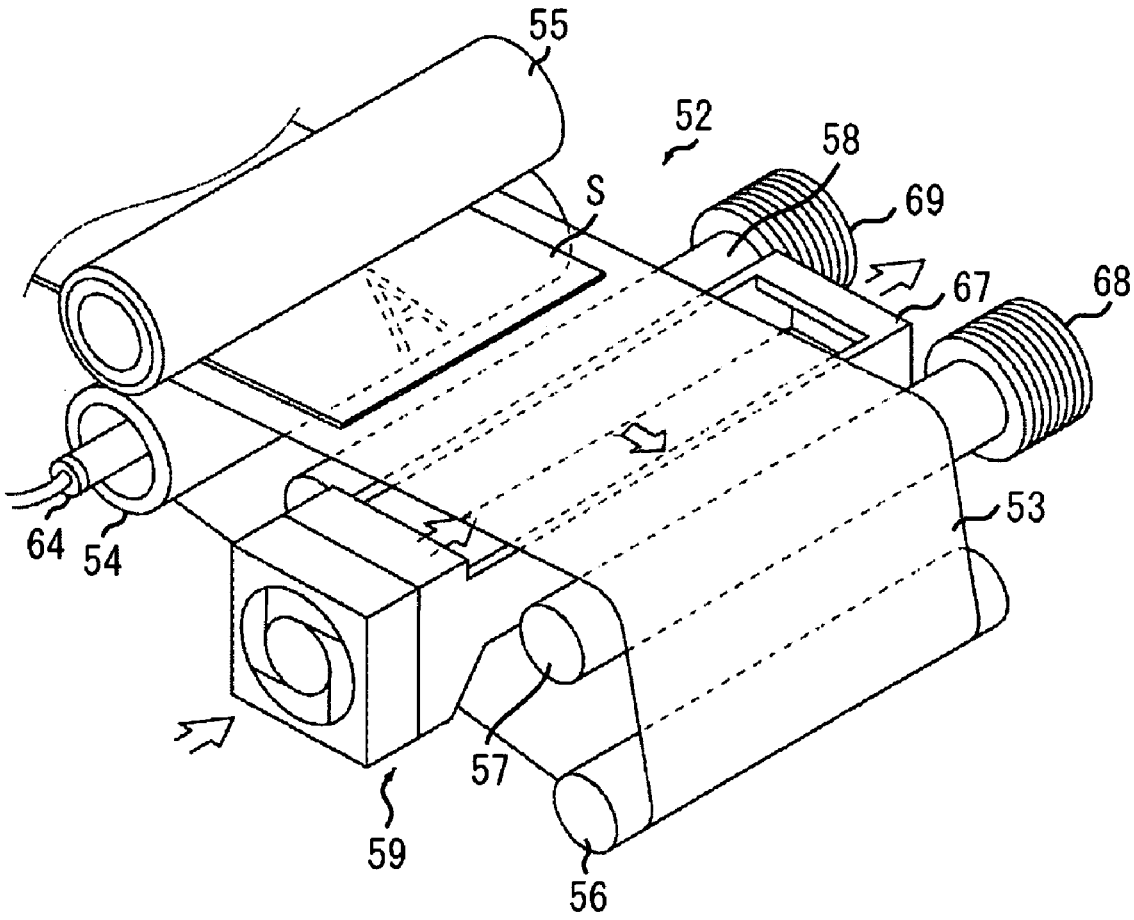
FIG. 13 is a perspective view illustrating a heating and cooling device in the second fixing device according to the second exemplary embodiment.

FIG. 13 is a perspective view illustrating a heating and cooling device 52 in the second fixing device 51.

A main part of the heating and cooling device 52 includes a fixing belt 53, a heating roller 54, a pressing roller 55, a supporting roller 56 supporting the fixing belt 53, a separation roller 57, a cooling roller 58 and a cooling fan 59.

The sheet S may be a recording medium applicable to the image forming apparatus 1. According to the present exemplary embodiment, in order to acquire a highly-glossy image output, a sheet is formed of double layers including a transparent resin layer made of a thermoplastic resin as a main component on an upper surface of a paper layer. Further, a broken line A illustrates the toner image formed on the resin layer included in the sheet S.

The fixing belt 53 is an endless belt made of a heat resistant material such as polyamide film as a basic material and be provided with a surface layer whose surface is smooth enough so that the sheet can be easily removed. The heating roller 54 is a cylindrical metal roller made of aluminum or stainless and includes a surface layer coated with an elastic layer as necessary.

Inside the heating roller 54, a heating source 64 such as a halogen heater is disposed. Further, the heating roller 54 is rotated by a driving source (not illustrated) to rotate and drive the fixing belt 53.

The pressure roller 55 is a hollow cylindrical roller that is made of aluminum and includes an elastic layer on a surface layer of the pressure roller 55. The pressure roller 55 includes a heating source such as a halogen heater therein as necessary. The pressure roller 55, which opposes the heating roller 54, is pressed by a pressure member (not illustrated) sandwiched across the fixing belt 53 to form a nip, and is driven to rotate.

The separation roller 57 has an outer diameter of Φ 40 mm or less and separates the sheet S that is closely attached to the surface of the fixing belt 53 and is fed by the fixing belt 53 due to a curvature and rigidity of the sheet S. The supporting roller 56 is disposed as a tension roller for applying a tensile force to the fixing belt 53 or a roller for correcting meandering of the fixing belt 53.

The toner image (broken line A) fixed by the pressure roller 55 and the heating roller 54 is cooled by wind from the cooling fan 59 when running on the fixing belt 53, and firmly fixed onto the transparent resin layer on the sheet S. Further, the wind applied by the cooling fan 59 passes through a duct 67 and cools fins 68 and 69 provided respectively on end portions of the separation roller 57 and the cooling roller 58 to cool a temperature on surfaces of the separation roller 57 and the cooling roller 58. Thus, the fixing belt 53 in contact with the separation roller 57 and the cooling roller 58 as described above is cooled.

Figure 14:
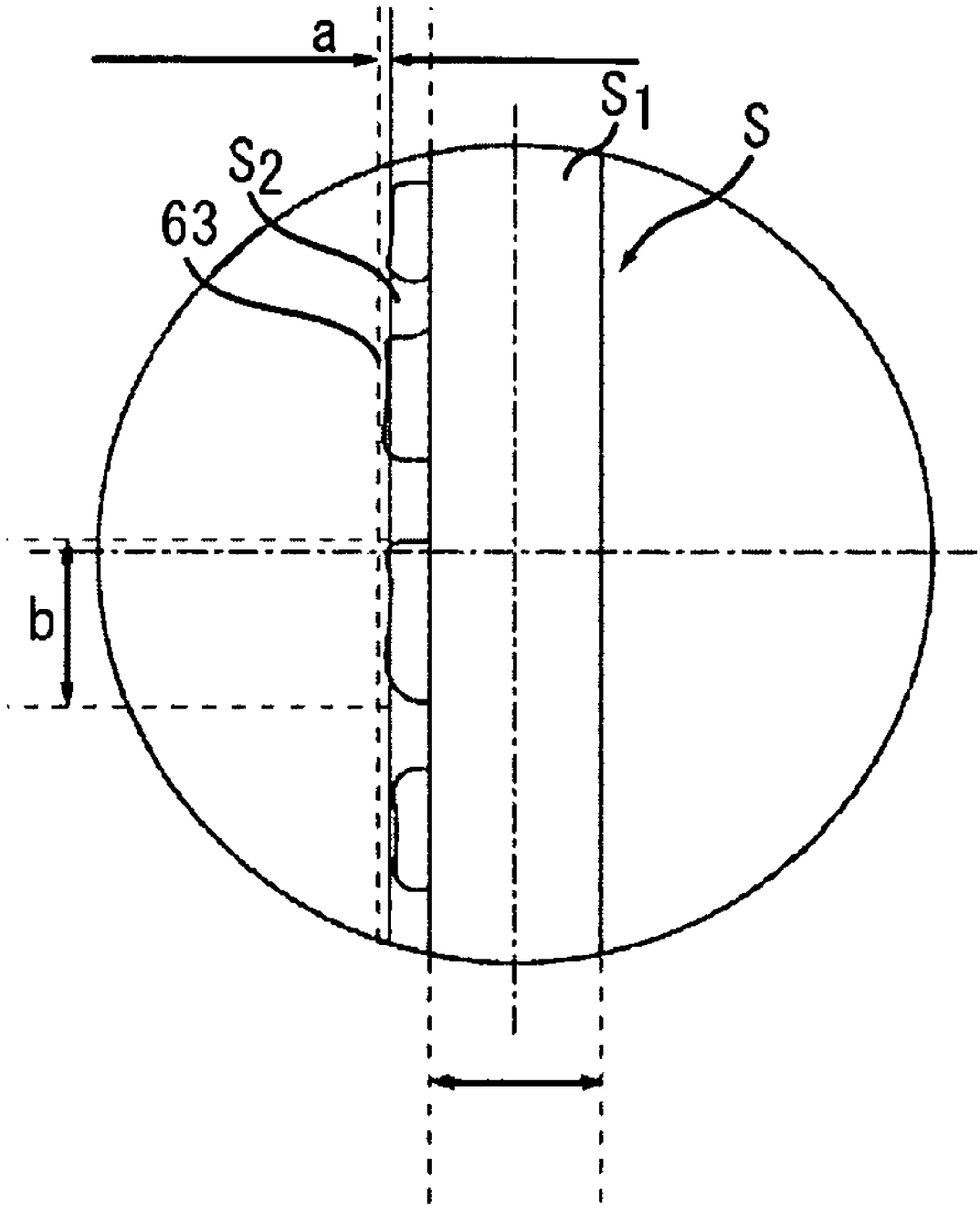
FIG. 14 is one example of image information on an end portion of a test sheet according to the second exemplary embodiment.

FIG. 14 is one example of the image information of the end portion of the test sheet 20.

The sheet used in the present exemplary embodiment includes a pulp layer S1 and a resin layer S2. The toner image 63 is infiltrated and firmly fixed into the resin layer S2. The feature amount is obtained from a detected image, for example, a protrusion amount "a" of the toner image 63 from the resin layer and an infiltration length "b" of the toner image 63 are obtained. The heating source 64 is controlled to ensure the better fixability depending on whether the protrusion amount "a" or the infiltration length "b" is within each of predetermined ranges.

Especially, according to the fixing type of the present exemplary embodiment, smoothness of the upper surface of the toner image 63 is essential to increase gloss of the image. Thus, the protrusion amount "a" is small as much as possible. For example, when the protrusion amount "a" is larger than a predetermined value, the toner has insufficiently melted, which causes insufficient infiltration of the toner. Thus, enough gloss is not acquired. Therefore, in this case, the CPU 32 controls the heating source 64 in the heating roller 54 so that the fixing control circuit 29 increases the fixing temperature.

Further, when the infiltration length "b" is larger than the predetermined value, it is considered that the good image cannot be obtained because the toner melts too much and spreads out, which causes the crushed toner. Thus, the CPU 32 controls the heating source 64 in the heating roller 54 so that the fixing control circuit 29 decreases the fixing temperature.

As described above, in the image forming apparatus according to the second exemplary embodiment, the fixability of the toner on the sheet is kept constant similar to the first exemplary embodiment to prevent the image from being deteriorated due to the poor fixing.

In addition, according to the present exemplary embodiment, when the image forming apparatus 1 is turned on or the image is adjusted, the end surface of the test sheet 20 is read to control the fixing as described above.

Further, in the above descriptions, the color image forming apparatus using the electronic photograph type as the image forming apparatus 1 is described as an example, however, the present invention may also be applied to a monochrome image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-118805 filed Apr. 30, 2008, which is hereby incorporated by reference herein in its entirety.

What is claimed is:

1. An image forming apparatus comprising:

an image bearing member configured to bear a toner image on a surface thereof;

a transfer unit configured to transfer the toner image on the image bearing member to a sheet;

a fixing unit configured to heat and fix the toner image on the sheet transferred by the transfer unit;

a reading unit configured to read the sheet that has passed through the fixing unit, from an end surface of the sheet;

a control unit configured to control a fixing temperature when the fixing unit heats and fixes the toner image on the sheet, based on an image read by the reading unit;

a skew-feed unit configured to skew feed a sheet in a direction of approaching to the reading unit; and a stop unit configured to stop the sheet that is skew fed by the skew-feed unit to adjust a position.

2. The image forming apparatus according to claim 1, further comprising an exposure unit configured to form an electrostatic latent image on the surface of the image bearing member so that image patterns are formed having a predetermined width and predetermined spaces therebetween on the end surface of the sheet, wherein the reading unit reads the image patterns formed on the end portion of the sheet having the predetermined width and the predetermined spaces therebetween, from a side surface of the sheet.

3. The image forming apparatus according to claim 1, wherein the control unit calculates a thickness of the toner based on the image read by the reading unit, and controls the fixing unit to increase the fixing temperature when the thickness of the toner is larger than a predetermined value.

4. The image forming apparatus according to claim 1, wherein the control unit calculates a width of the toner based on the image read by the reading unit, and controls the fixing unit to decrease the fixing temperature when the width of the toner is larger than a predetermined value.

5. The image forming apparatus according to claim 1, further comprising a sheet-thickness detecting unit configured to detect a thickness of the sheet before the toner image on the sheet is heated and fixed by the fixing unit, wherein the control unit calculates a shrinkage rate of the sheet from the thickness of the sheet before fixing detected by the sheet-thickness detecting unit and the thickness of the sheet after the fixing calculated based on the image read by the reading unit, and controls the fixing unit to decrease the fixing temperature when the sheet is shrunk at the shrinkage rate of a predetermined value or more.

6. The image forming apparatus according to claim 1, wherein the control unit calculates an infiltration amount of the toner image into the sheet based on the image read by the reading unit, and controls the fixing unit to increase the fixing temperature when the infiltration amount is smaller than a predetermined value.

7. An image forming apparatus comprising:

an image bearing member configured to bear a toner image on a surface thereof;

a transfer unit configured to transfer the toner image on the image bearing member to a sheet;

a fixing unit configured to heat and fix the toner image on the sheet transferred by the transfer unit;

a reading unit configured to read the sheet that has passed through the fixing unit, from an end surface of the sheet; and a control unit configured to control a fixing temperature when the fixing unit heats and fixes the toner image on the sheet, based on an image read by the reading unit, wherein the fixing unit applies heat to the sheet including a resin layer on an upper surface of a paper layer and embeds the toner image formed on the resin layer into the resin layer to be fixed, and wherein the control unit calculates a protrusion amount of the toner image from the resin layer based on the image read by the reading unit, and controls the fixing unit to increase the fixing temperature when the protrusion amount is larger than a predetermined value.

8. An image forming apparatus comprising:

an image bearing member configured to bear a toner image on a surface thereof;

a transfer unit configured to transfer the toner image on the image bearing member to a sheet;

a fixing unit configured to heat and fix the toner image on the sheet transferred by the transfer unit;

a reading unit configured to read the sheet that has passed through the fixing unit, from an end surface of the sheet; and a control unit configured to control a fixing temperature when the fixing unit heats and fixes the toner image on the sheet, based on an image read by the reading unit, wherein the fixing unit applies heat to the sheet including a resin layer on an upper surface of a paper layer and embeds the toner image formed on the resin layer into the resin layer to be fixed, and wherein the control unit calculates an infiltration length that is a length of region where the toner image infiltrates into the resin layer, based on the image read by the reading unit, and controls the fixing unit to decrease the fixing temperature when the infiltration length is larger than a predetermined value.

* * * * *